United States Patent [19]

Engle

[11] Patent Number: 4,874,065

[45] Date of Patent: Oct. 17, 1989

[54] PARKING BRAKE SYSTEM FOR RAILWAY VEHICLES

[75] Inventor: Thomas H. Engle, Clayton, N.Y.

[73] Assignee: General Signal Corporation, Stamford, Conn.

[21] Appl. No.: 160,900

[22] Filed: Feb. 26, 1988

Related U.S. Application Data

[62] Division of Ser. No. 932,418, Nov. 19, 1986, Pat. No. 4,746,171.

[51] Int. Cl.[4] ..... F16D 65/30

[52] U.S. Cl. ..... 188/265; 92/21 MR

[58] Field of Search ..... 92/20, 21, 21 MR, 23; 188/107, 167, 170, 265; 303/89

[56] References Cited

U.S. PATENT DOCUMENTS

| | | | |
|---|---|---|---|
| 2,183,444 | 12/1934 | Collins | 188/265 X |
| 2,227,661 | 1/1941 | Martinson | 188/265 X |
| 2,600,758 | 6/1952 | Gross | 188/265 |
| 3,402,792 | 9/1968 | Masser | 188/170 |
| 3,508,794 | 4/1970 | Engle | 303/10 |
| 4,033,629 | 7/1977 | Spalding | 303/2 |
| 4,236,424 | 12/1980 | Kanjo et al. | 74/505 |
| 4,279,332 | 7/1981 | Morgan et al. | 188/170 |

*Primary Examiner*—Duane A. Reger

*Attorney, Agent, or Firm*—Robert R. Hubbard; Harold S. Wynn

[57] ABSTRACT

A fluid brake system has a brake pipe, a control valve device, a brake cylinder and a brake rigging, and in addition, a handbrake pipe, a protective device, a fluid pressure releasable spring handbrake cylinder, and a manually operable handbrake device for selectively governing brakes of the brake rigging under varying conditions, as when air supply is disconnected from a train. A moveable fulcrum in the manual handbrake device permits manual release of spring applied handbrakes in combination with a resetable toggle locking connection to a handbrake rod.

7 Claims, 4 Drawing Sheets

PARKING BRAKE SYSTEM FOR RAILWAY VEHICLES

This is a divisional of co-pending application Ser. No. 932,418 filed on 11/19/86 now U.S. Pat. No. 4,746,171.

BACKGROUND OF THE INVENTION

This invention relates to spring applied air pressure released parking brakes for railway vehicles, and it more particularly relates to parking brakes governed jointly by fluid spring handbrake cylinders as well as manual handbrake control devices. It has been proposed, as in the Spalding U.S. Pat. No. 4,033,629, granted July 5, 1977, that a parking brake system having a spring applied and fluid pressure released handbrake cylinder be provided having a special reserve reservoir for providing release pressure to provide handbrake operation in the absence of pressure in the brake pipe. This special reservoir pressure must be carried above normal brake pipe pressure, requiring a special compressor to raise the pressure, and at times the attachment of an additional supply of fluid pressure to the system is required.

An object of the present invention is to provide a parking brake system to overcome limitations in the above described system.

Another object of the present invention is to make operation and release of parking brakes always available by either fluid pressure control or by manual operation.

Another object of the present invention is to automatically reset any manually released handbrake mechanisms when fluid pressure is restored to a handbrake train pipe.

Other objects, purposes and characteristic features of the present invention will be in part obvious from the accompany drawings, and in part, pointed out as the description of the invention progresses.

SUMMARY OF THE INVENTION

A conventional fluid brake control system for a railway vehicle is provided having a brake pipe, control valve device, and a brake cylinder for selectively governing the application of force to the brakes of a brake rigging in accordance with fluid pressure in the brake pipe. Additional apparatus for parking brake control is provided including a handbrake release pipe, a protective device, a fluid pressure releaseable spring handbrake cylinder, and a mechanical manual handbrake device for selectively controlling the force applied to brakes of a brake rigging, irrespective of whether fluid pressure is available for use in releasing the brakes. This is made possible by linkage means connecting the manual handbrake control apparatus to the brake cylinder having a moveable fulcrum that is applied on a handbrake rod for connecting the handbrake spring brake cylinder and the handbrake rod to the brake cylinder for operating the brake rigging by either the spring brake cylinder or the manual handbrake rod independently.

IN THE DRAWINGS

Figure 1:
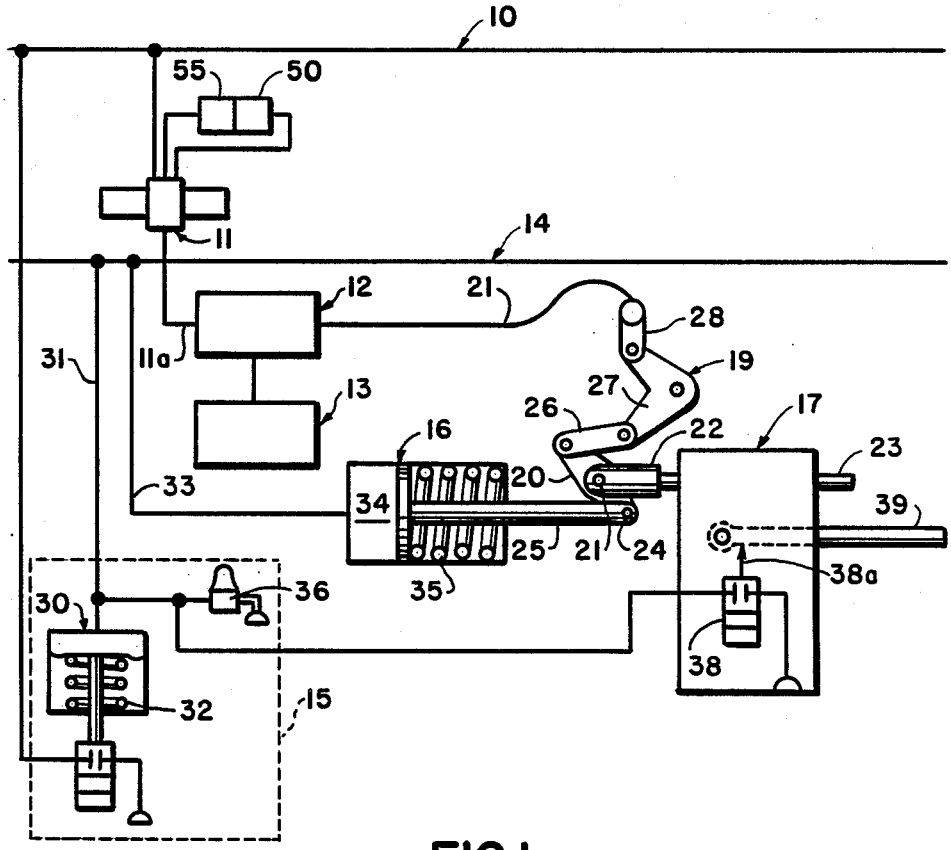
FIG. 1 is a schematic illustration of a two pipe type handbrake control system for a typical railway car according to a preferred embodiment of the present invention.

With reference to FIG. 1, a fluid brake control system is illustrated as having a conventional brake pipe 10, a control valve device 11, a brake cylinder 12 and a brake rigging 13, all of which are operable in response to changes in fluid pressure in the brake pipe 10 according to usual practice, and as disclosed, for example, in the U.S. Kirk Pat. No. 3,175,869, in the Engle application Ser. No. 776,762, filed Sept. 16, 1985, and in the Bogenschutz, et al, U.S. Pat. No. 4,060,152, granted Nov. 29, 1977 that are hereby incorporated by reference.

A handbrake control system is provided including a train, or handbrake pipe 14, a protective device 15, a fluid pressure releaseable spring handbrake cylinder 16 and a manually operable handbrake mechanism having toggle type locking apparatus 18 (see FIG. 2), all of which is operable through linkage 19 to selectively operate the brake cylinder 12 for applying brakes to the vehicle through operation of the brake rigging 13.

The linkage 19 comprises a brake link 20 that is connected at its mid-point by a clevis pin 21 fastening a clevis 22 on a manual handbrake rod 23. The lower end of the brake link 20 is connected by a pin 24 to a spring handbrake rod 25, and the upper end of the brake link 20 is connected by a link 26 to a lower arm of a bell crank 27, the upper arm of which being connected through a link 28 to cables 29, which are connected to the piston (not shown) of brake cylinder 12 to actuate the brake rigging 13 to a brake application position by the rotation of the bell crank 27 in a clockwise direction for pulling on the cables 29.

Figure 1A:
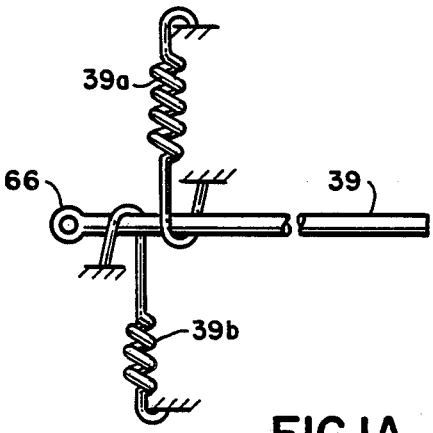
FIG. 1A is an enlarged illustration of a system for biasing a manual handbrake handle of FIG. 1 or FIG. 2 to a normal stowing position.

The protection device 15 is illustrated as comprising a diaphragm operated vent valve 30 that is continually comparing the fluid pressure in the train or handbrake pipe 14 over line 31 with the force of a graduating spring 32 in the valve 30 so as to insure that a sufficient pressure is applied from the train pipe 14 over a passage 33 to a chamber 34 for compressing spring 35 to maintain the handbrake control system in a normal released position. The protective device 15 also has a vent valve 36 that is controlled over line 37 by a pilot vent valve 38 in the manual handbrake mechanism 17. The pilot valve 38 is situated at point **38*a* to vent the train pipe 14 by movement of a handle 39 from its normal stow position, in which it is biased by springs 39*a* and 39*b* of FIG. 1A, to an application position. The vent valve 38 can be actuated, for example, by a spring biased shaft depressed at 38*a* by movement of the lever 39**.

Figure 4:
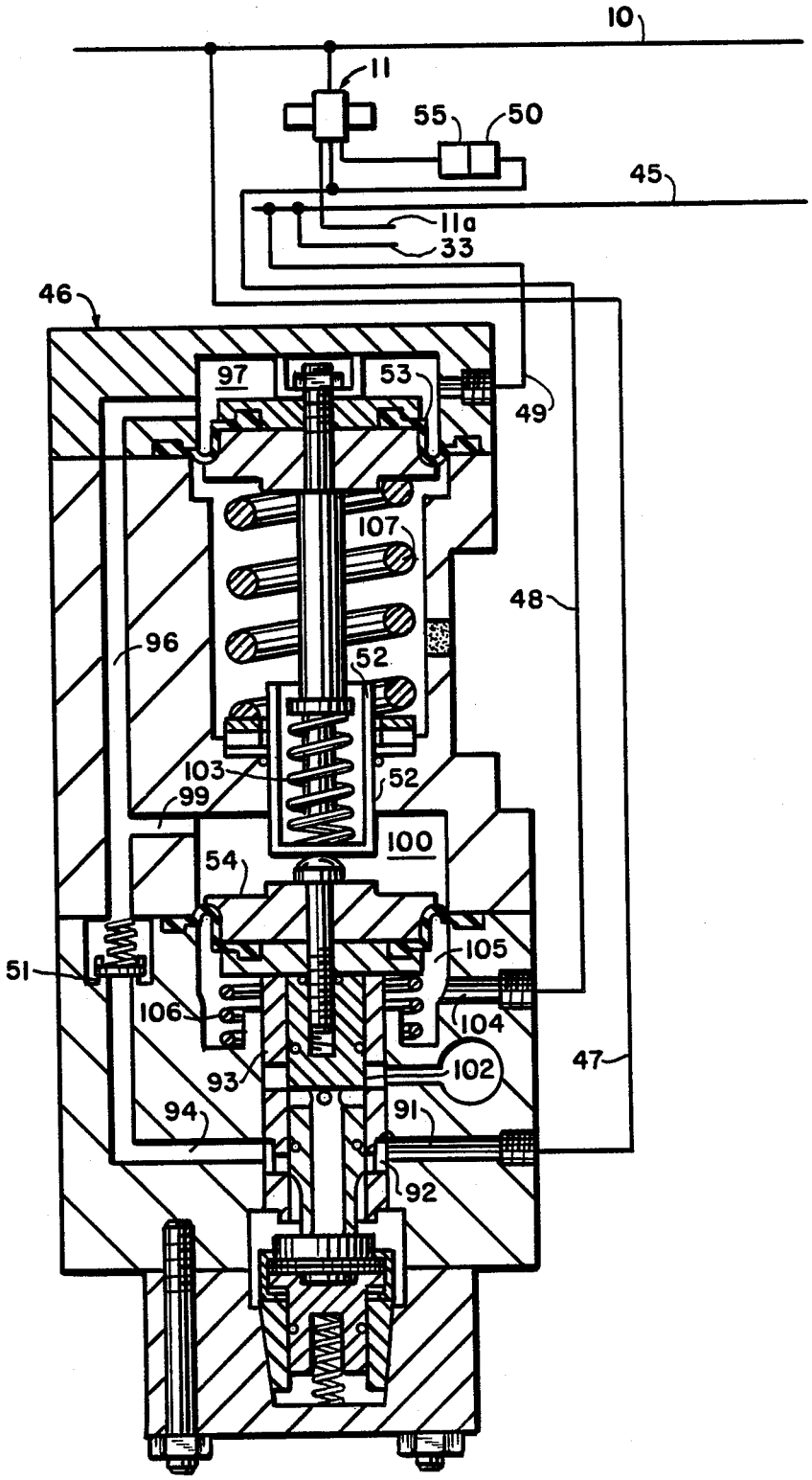
FIG. 4 is a schematic illustration of a modified form of the present invention for cars having a single train pipe.

With reference to FIG. 4, a modified form of the invention is applied to a single brake pipe braking system for connection throughout a train, while a local handbrake supply pipe 45 is used for each vehicle to supply fluid for the handbrakes of the various trucks of each car having seperately controlled handbrakes.

In this modification, fluid pressure for the handbrake supply pipe 45 is obtained from the brake pipe 10 by a modified protective device 46 having ports connected over lines 47, 48 and 49 to the brake pipe 10, an auxiliary reservoir 50 and supply pipe 45 respectively.

The protective device 46 comprises a charging check valve 51, a charging piston 52, a cut-off piston 53, and an exhaust piston 54.

Figure 2:
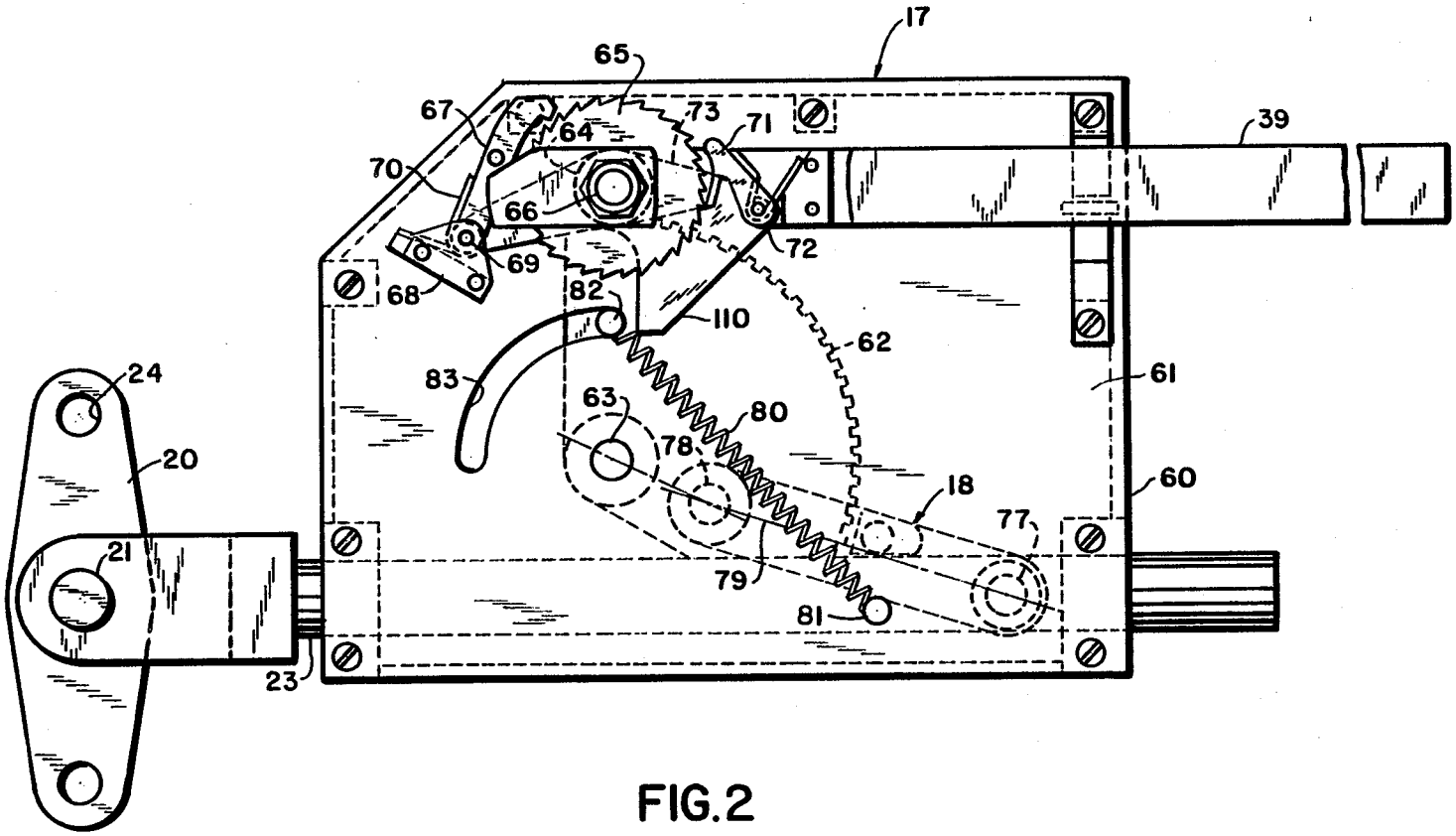
FIG. 2 is an elevational view of the manual handbrake mechanism of FIG. 1.
Figure 3:
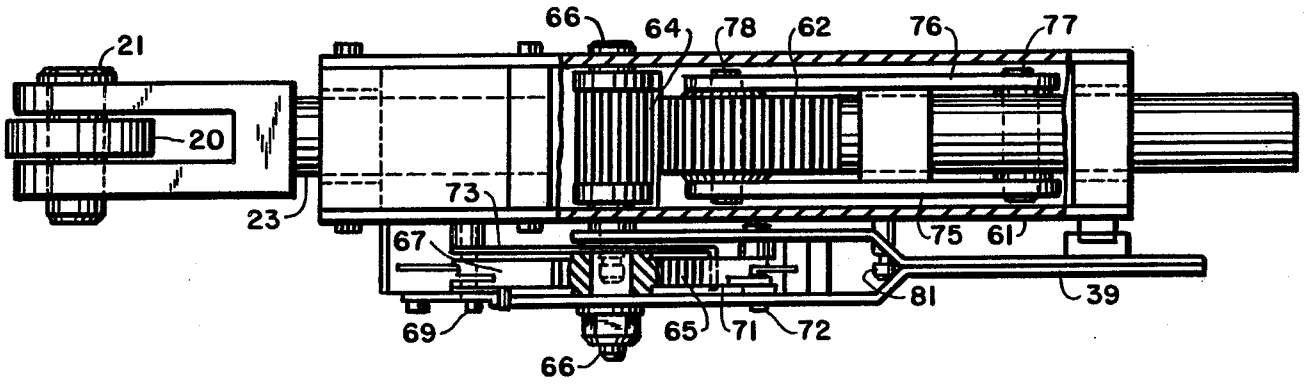
FIG. 3 is a plan view of the manual handbrake mechanism of FIG. 2.

With reference to FIGS. 2 and 3, the manual handbrake mechanism 17 comprises a housing 60 having a cover 61 for journalling the manual handbrake rod 23 and housing a sector gear 62 journalled by a journal pin 63 and driven manually by ratcheting a pinion gear 64. The gear 24 is driven by a ratchet wheel 65, both of which are secured on a shaft 66. The ratchet wheel has associated therewith a holding pawl 67 pivoted on a retaining plate at a point 69. The holding pawl 67 is biased against the ratchet wheel 65 by a spring 70. A driving pawl 71 is operably connected by pin 72 to the manually operable handle 39. A strike plate 73 coordinates operation of the driving pawl 71 and the holding pawl 67 and is preferably adjusted to release both the driving pawl 71 and the holding pawl 67 from engagement of the ratchet wheel 65 when the lever 32 is in a stow position in which it is biased by springs 39*a* and 39*b* of FIG. 1A.

The toggle locking mechanism 18 comprises laterally spaced over center links 75 and 76 pivotally secured at one end to the manual handbrake rod 23 by a hinge pin 77. The over center links 75 and 76 are journalled on a pin 78 operably connecting their other ends to an off center point 78 on the opposite sides respectively of the sector gear 62. The toggle mechanism 18 is shown in its reset position wherein the links 75 and 76 are in an over center position wherein the longitundinal center line 79 dips below a center line between the journal pin 63 of the sector gear and the hinge pin 77. From this position, the spring handbrake cylinder 16, which is connected at 24 can selectively apply and release the brakes of the brake rigging 13 without requiring operation of the manual handbrake rod 23, the rod 23 being locked against movement to the left by the toggle mechanism 18. A toggle spring 80 helps in positive operation of the toggle 18 to its locking and unlocking positions. The spring 80 is stretched between a pin 81 in the manual handbrake rod 23 and a pin 82 in the sector gear 23, which in turn operates in an annular slot 83 in the cover plate 61.

OPERATION

The operation of the system, according to FIG. 1, as governed by the brake pipe 10, is according to usual practice wherein the control valve 11 and the auxiliary and emergency reservoirs 50 and 55 provide control for a conventional brake cylinder 12, which in turn operates the brakes of a brake rigging 13 in the usual manner. The train pipe 14 is normally pressurized to maintain all of the spring handbrake cylinders 16 that are connected thereto in released positions, and the handbrakes are not normally applied unless initiated manually by operation of a manual handbrake unit 17, which must generally take place when the train is stopped. Once a manual handbrake mechanism is actuated by operation of its lever 39 to an application position, for example, the pilot valve 38 is actuated to exhaust air over passage 37, and it in turn causes actuation of the vent valve 36 in protective device 15, which causes exhaust of fluid pressure in the train pipe 14 over passage 31. This also vents air from the brake pipe over passage 32*a*, but if the train is stopped, the air is generally vented from the brake pipe 10 at this time anyway.

When fluid is vented from chamber 34 of the spring handbrake cylinder 16, the spring 35 expands and draws the handbrake rod 35 within the cylinder 16 to the left to actuate the brake link 20 of the linkage 19 in a clockwise direction and thus cause the cables 29 to be actuated to the right within a conduit, or the like (not shown) and thus operate a piston (not shown) of cylinder 12 to an application position for applying brakes of the brake rigging 13. Because of the train line 14 being vented to atmosphere, all spring handbrake cylinders 16 connected thereto are spring actuated to apply associated brakes in the same manner that has been described. The brake thus applied can be released, either by supplying air to the spring handbrake cylinders 16 through the train pipe 14, or by operating the levers 39 of similar devices 17 to their release positions. In the first case, the brakes will be released because air will compress the spring 35 within the spring handbrake cylinder 16, while in the second case, the brakes will be released because a fulcrum point 21 in each case is allowed to move to the left, thus allowing the spring brake cylinder 16 to go to full travel of the spring 35 for releasing the brakes of the brake rigging 13.

The protection valves 15 serve to prevent application of brakes by the spring handbrake cylinders 16 without knowledge of the train operators. In operation, this device senses the pressure in the chamber 34 of the spring handbrake cylinder 16, and if this pressure is below a pressure for maintaining the brakes released, which may be 40 lbs. pressure, for example, the protection device 15 vents the brake pipe 10 to atmosphere, causing the brakes on the entire train to apply in emergency. This prevents the dangerous condition of the dragging of a single spring applied handbrake for a long distance on an otherwise released train.

When a train has stopped, should a trainman wish to apply the handbrakes, the only action he is required to take is simply to move the handle 39 of the device 17 from a normal stow position to an application position. If there is fluid in the spring handbrake cylinder 16, this action will operate the pilot vent valve 38, causing the venting of spring handbrake cylinder 16 fluid through the vent valve 36 to vent all handbrake cylinders 16 and apply brakes of the brake rigging 13. If there is no fluid in the handbrake system, ratcheting the handle 39 between the stow and apply positions causes the application of a previously released spring brake by retracting the fulcrum point 21 in the direction of the housing of the manual handbrake mechanism 17, thus permitting the handbrake spring 35 to actuate the brake rigging 13 to an application position by rotation of brake link 20 in a clockwise direction when fulcrum point 21 is moved to the right. Thus, to apply the handbrake, the operators action with or without fluid pressure in the train pipe 14 is always the same, to move the operating handle 39 to the application position.

With reference to FIG. 4, operation will now be considered of the modification to require only a single continuous brake pipe 10 extending throughout the train. This form is modified from FIG. 1 primarily in a protective device 46 in that an additional piston 52 operates to permit charging of supply pipe 45 when brake pipe pressure is below 55 psi as long as the brake pipe 10 is being charged. This charging take place in the protective device 46 from the brake pipe 10 over passage 48, passage 91, through an open passage 92 in a spool valve 93, charging check valve 51, passage 96, to a chamber 97 over a cut-off piston 53, and over passage 49 to a supply pipe 45. Brake pipe fluid pressure is also applied from passage 96 through passage 99 to a chamber 100 above an exhaust piston 54.

This charging of the supply pipe 45 is accomplished only if the exhaust valve 102 can be held closed by a 10 lb. spring 103 in piston 52 to hold valve 102 closed subsequently until supply pressure builds up over 55 lbs. by a pressure differential between brake pipe pressure in chamber 100 and auxiliary reservoir pressure of reservoir 50 that is applied over passages 48 and 104 to chamber 105 beneath piston 54. A 1 lb. spring under piston 101 assures that the vent valve 102 will remain closed until brake pipe pressure in chamber 97 is above 55 lbs. as long as brake pipe pressure is increasing to hold the vent valve 102 closed because of being higher pressure than the force of a 55 lb. spring 107 beneath the charging piston 53. With brake pipe pressure above 55 lbs., the cut-off piston 53 moves down, and stays down to close vent valve 102, irrespective of pressure differential between brake pipe pressure and auxiliary reservoir 50 pressure. When the auxiliary reservoir 50 is fully charged, there is a substantial balance in forces across piston 54 and the piston 53 is free to sense when pressure in supply line 45 drops below 55 lbs. to vent fluid from the brake pipe 10 over passage 47, and cause an emergency application of the brakes of the train.

In the event of an emergency brake application, when the brake pipe pressure drops below 55 lbs., the supply pipe 45 remains fully charged because of check valve 51 preventing the protection device 46 from sensing a reduction in brake pipe pressure. Therefore, the spring handbrake cylinders 16 remain in their normally charged condition to prevent application of emergency brakes and handbrake at the same time.

In operation of the manual handbrake mechanism 17 (see FIGS. 2 and 3) the mechanism as illustrated can be said to be in a reset position as shown, with the manual handbrake rod 23 retracted to the right and locked against movement to the left by the toggle mechanism 18. From this position of the fulcrum pin 21, the spring handbrake cylinder 16 rotates the brake link brake release (see FIG. 1). However handbrake application, must be initiated by actuating a handbrake lever 39 from its normal stow to an application position. The handle 39 is biased by springs 39*a* and 39*b* (see FIG. 1A) to be restored to the stow position in which it is shown when released by an operator. In the stow position both pawls 67 and 71 are released from the ratchet wheel 65.

To apply the handbrakes with fluid pressure in the handbrake cylinder 16, a manual lever 39 is moved to an application position, which in FIG. 2 is upwardly, but in FIG. 1, the mechanism 17 is disposed in the opposite direction, and movement of lever 39 is downwardly from its stow position for handbrake application. This actuates the pilot vent valve 38 of FIG. 1 as has been described to vent the handbrake release train pipe 14 and cause springs 35 to expand in their cylinders 16 and apply the brakes of riggings 13 by clockwise rotation of the brake links 20. The reverse operation is effective upon restoration of fluid pressure to the train pipe 14 to release the handbrakes.

If it is necessary to release a spring applied handbrake, with no fluid pressure in train pipe 14, this is accomplished by manual operation of lever 39 to a release position, which is downwardly in FIG. 2, this brings a point 110 on the left hand end of lever 39, that is pivoted at 66, into contact with pin 82 of the sector gear 62 to rotate that gear in a counter clockwise direction to unlock the toggle 18 by moving pin 78 upwardly. As soon as the pin 78 of sector gear 62 is above a center line between pins 77 and 63, the manual handbrake rod 23 is drawn outwardly by spring 35 (see FIG. 1) in the handbrake cylinder 16 until the spring 35 bottoms out in cylinder 16. The distance of travel for rod 23 under these conditions is selected to be sufficient for the release of brakes of the brake rigging 13, which by using slack adjusters, may be about 4 inches, and which is obtained by rotation of bell crank 19 in a clockwise direction by extension of the rod 23 to the left. The toggle spring 80 snaps pin 82 in its groove 83 into its released position, with the sector gear 62 rotated counter clockwise.

If, after having released the brakes of the rigging 13 manually as described above, it is desirable to reapply the handbrakes, still with no fluid pressure in the train pipe 14, this is done by operation of lever 39 from its stow position to ratchet the gear sector 62 in a clockwise direction about the journal pin 63 to retract rod 23 and relock the toggle mechanism 78 in its lower position. This operation of rod 23 moves the fulcrum point 21 on rod 23 to the right to carry with it brake link 20 and thus operates bell crank 19 counter clockwise to reapply brakes of brake rigging 13.

Upon restoration of fluid pressure to the train line 14, after brakes have been manually released without fluid pressure as described above, pressurization of cylinders 16 resets any of the manual mechanism 17 that have been operated to this release position by actuating rods 23 to the right to rotate the gear sectors 62 clockwise to cause springs 80 (see FIG. 2) to snap the toggle mechanism 18 into their locked positions, and thus restore the system to its normal positions.

The different forms of the invention described are to be considered as typical of various forms the invention can assume.

I claim:

1. A manual handbrake mechanism adapted to selectively govern utilization of a spring handbrake cylinder to control brakes of a brake rigging comprising;

(a) a handbrake mechanism housing, (b) a handbrake rod journalled in the housing for axial movement to first and second axially operated positions, (c) locking means in the housing for selectively limiting axial movement of the handbrake rod in a particular direction, (d) a manual handbrake handle for selectively governing the locking means, and (e) the locking means being in the form of a toggle that is normally in a reset locking position restraining the handbrake rod against axial movement in a particular direction.

2. A manual handbrake mechanism according to claim 1 wherein the manual handbrake handle has a stow position from which it can be actuated to release and application positions for respectively actuating the toggle locking means to unlocked and reset locking positions.

3. A manual handbrake mechanism according to claim 2 wherein the manual handbrake handle is biased to its stow position.

4. A manual handbrake mechanism according to claim 1 wherein the locking means comprises;

(a) a ratchet and pinion gear mechanism, (b) a sector gear journalled on a pin in the housing and driven by manually ratcheting the pinion gear mechanism, (c) a toggle mechanism having longitudinal linkage pivotally connected at one end to the handbrake rod and at the other end to an off center journal pin in the sector gear; and (d) and a toggle spring connecting points on the handbrake rod and the sector gear and operable to locking and unlocking positions on opposite sides of the pin journalling the sector gear.

5. A manual handbrake mechanism according to claim 4 wherein the locking means can be actuated from its unlocked position to its locking position by application of an axial force to the handbrake rod.

6. A manual handbrake mechanism according to claim 5 wherein the locking means can be actuated from its unlocked position to its locking position by actuation of the manual handbrake handle for ratcheting the sector gear to actuate the toggle mechanism to its locking position.

7. A manual handbrake mechanism according to claim 5 wherein the ratchet and pinion gear mechanism has driving and holding pawls that are both released from a ratchet wheel when the manual handbrake handle is in a stow position.

* * * * *